US008371386B2

(12) United States Patent
Malone

(10) Patent No.: US 8,371,386 B2
(45) Date of Patent: Feb. 12, 2013

(54) ROTATABLE VALVE FOR DOWNHOLE COMPLETIONS AND METHOD OF USING SAME

(75) Inventor: Scott Malone, Needville, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 431 days.

(21) Appl. No.: 12/506,617

(22) Filed: Jul. 21, 2009

(65) Prior Publication Data

US 2011/0017469 A1 Jan. 27, 2011

(51) Int. Cl.
*E21B 34/06* (2006.01)
*E21B 34/10* (2006.01)

(52) U.S. Cl. .... 166/373; 166/386; 166/330; 137/625.47

(58) Field of Classification Search ..... 166/373, 166/386, 330, 331, 332.2, 332.3; 137/625.47
See application file for complete search history.

(56) References Cited

U.S. PATENT DOCUMENTS

| | | | | | |
|---|---|---|---|---|---|
| 2,616,503 | A | * | 11/1952 | Armentrout | 166/104 |
| 2,810,441 | A | * | 10/1957 | Baker | 166/124 |
| 3,665,955 | A | * | 5/1972 | Conner, Sr. | 137/495 |
| 3,678,960 | A | | 7/1972 | Leibinsohn | |
| 5,174,379 | A | | 12/1992 | Whiteley | |
| 5,706,905 | A | * | 1/1998 | Barr | 175/61 |
| 5,826,657 | A | | 10/1998 | Ringgenberg | |
| 6,220,353 | B1 | | 4/2001 | Foster | |
| 6,488,082 | B2 | | 12/2002 | Echols | |
| 6,575,246 | B2 | | 6/2003 | Bixenman et al. | |
| 6,719,064 | B2 | | 4/2004 | Price-Smith | |
| 6,745,834 | B2 | | 6/2004 | Davis | |
| 6,786,285 | B2 | | 9/2004 | Johnson | |
| 7,013,917 | B2 | | 3/2006 | Joseph, III | |
| 7,195,225 | B1 | | 3/2007 | Holliday | |
| 7,712,524 | B2 | | 5/2010 | Patel | |
| 2008/0128130 | A1 | | 6/2008 | Whitsitt | |
| 2009/0025923 | A1 | | 1/2009 | Patel | |
| 2009/0145603 | A1 | | 6/2009 | Coronado | |
| 2009/0205834 | A1 | * | 8/2009 | Garcia et al. | 166/373 |
| 2009/0288833 | A1 | * | 11/2009 | Graham et al. | 166/306 |

* cited by examiner

*Primary Examiner* — Shane Bomar
*Assistant Examiner* — Robert E Fuller
(74) *Attorney, Agent, or Firm* — David G. Matthews; Brandon Clark; Robb D. Edmonds

(57) ABSTRACT

Method and apparatus for performing a series of downhole operations. The method can include conveying a work string with an integrated valve into a wellbore. As the work string with the integrated valve is conveyed into the wellbore, the valve can be in a first operation mode. When the valve is located within the wellbore, the valve can be adjusted to a different operation mode by selectively rotating at least a portion of the valve without longitudinal movement of the valve relative to the wellbore.

20 Claims, 5 Drawing Sheets

ROTATABLE VALVE FOR DOWNHOLE COMPLETIONS AND METHOD OF USING SAME

BACKGROUND

Completion assemblies for downhole operations are typically conveyed to a desired location within the wellbore and anchored or positioned within the wellbore by a service tool. Upon placement of the completion assembly, numerous well operations, such as perforation, fracing, gravel packing, etc., can be performed using a variety of completion tools, such as sand screens, bridge plugs, packers, pumps, just to name a few. Successful completion of these operations typically requires numerous movements of the service tool to actuate or operate the respective completion tools. For successful operations, an operator must have knowledge of the downhole service tool as well as an ability to visualize the operation, location, and status of the service tool within the well.

In a typical operation, the operator runs a work string, a service tool, and a lower completion into the well bore until a desired location is reached. The operator then marks the work string at the surface to indicate the respective location of the tool within the lower completion. The work string and the service tool are decoupled from the lower completion, and the work string and service tool are longitudinally moved within the lower completion. As the service tool is moved within the lower completion, the marks on the service tool are assumed to indicate specific positions of the service tool within the lower completion.

This procedure, however, relies on substantial knowledge and experience of the operator and is prone to error. Such error is most typically caused by the expansion and contraction of the work string as it is lowered into and retrieved from the wellbore. Such length differentials are most likely caused by temperature and/or pressure fluctuations within the wellbore that cause the work string to expand or contract. Moreover, in highly deviated wellbores with difficult trajectories, much of the string movement is lost between the surface and the downhole location due to string buckling, compression, and the like. In such systems where gravel packs are performed, the service tool can be prone to sticking with respect to the downhole completion assembly.

There is a need, therefore, for a downhole tool capable of performing multiple downhole operations without requiring longitudinal movement relative to the wellbore.

SUMMARY

Methods and apparatus for performing a series of downhole operations are provided. In at least one specific embodiment, a work string is conveyed with an integrated valve into a wellbore. As the work string is conveyed into the wellbore, the valve can be in a first operation mode. When the valve is disposed within the wellbore, the valve is adjusted to a different operation mode by rotating at least a portion of the valve without longitudinal movement of the valve relative to the wellbore.

In at least one specific embodiment, the apparatus includes a housing having a first end and a second end. A flow gland can be disposed at each end of the housing. Each flow gland can have at least one flow port formed therethrough. A body having a plurality of channels formed therethrough can be disposed within the housing. The body can be rotatable within the housing to selectively isolate at least one of the channels to provide an operation mode of the valve.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
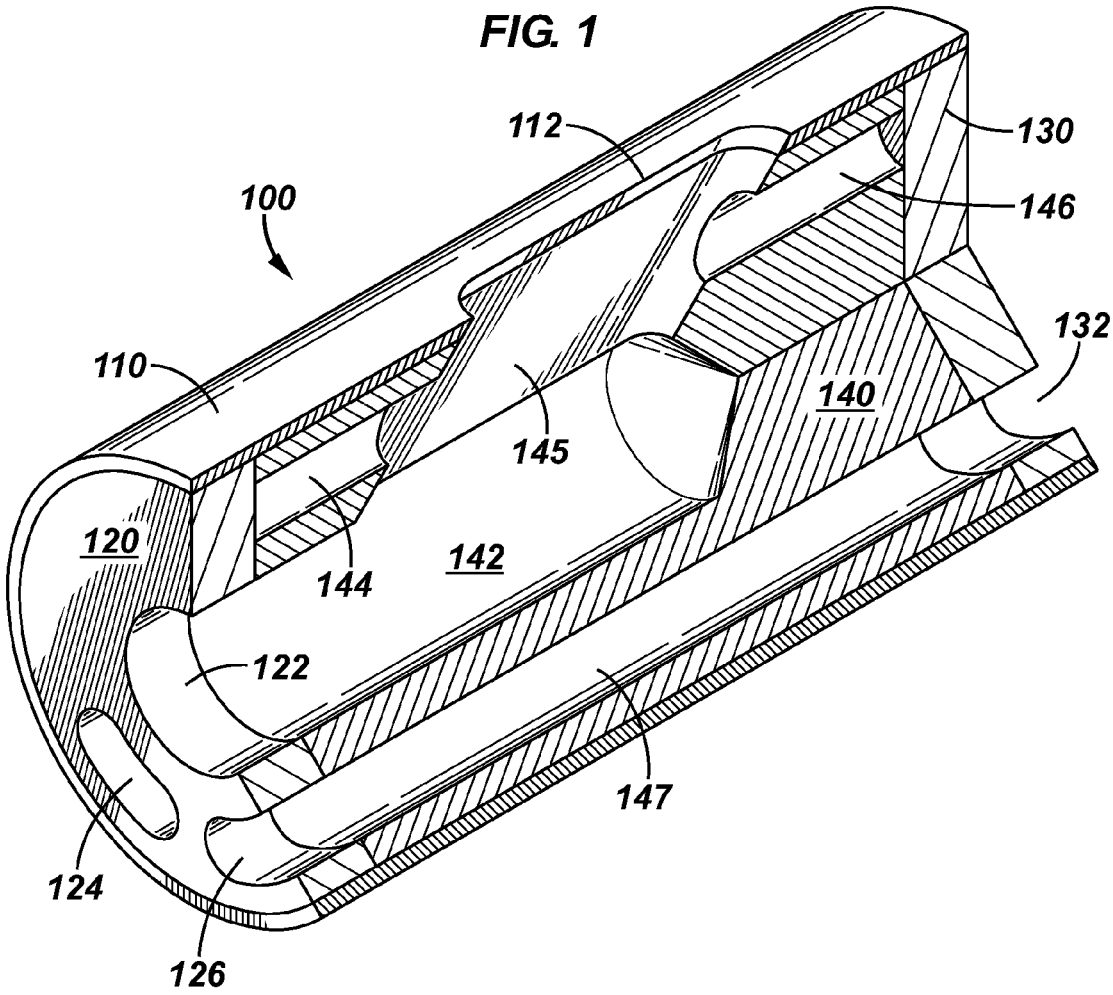
FIG. 1 depicts a cross-sectional view of an illustrative valve, according to one or more embodiments described.

FIG. 1 depicts a cross-sectional view of an illustrative valve, according to one or more embodiments. The valve 100 can include one or more housings 110, one or more bodies 140, and one or more flow glands (two are shown 120, 130). Each housing 110 can be at least partially disposed about the one or more bodies 140. Each body 140 can include one or more channels or openings 142, 144, 145, 146, 147 at least partially formed therethrough. Each channel 142, 144, 145, 146, 147 can be independently isolated and/or aligned with respect to the housing 110 and/or flow glands 120, 130 to provide one or more flow paths through the valve 100. As such, the valve 100 can be selectively switched between various operation modes and can be used to perform multiple downhole operations in a single trip.

Figure 2:
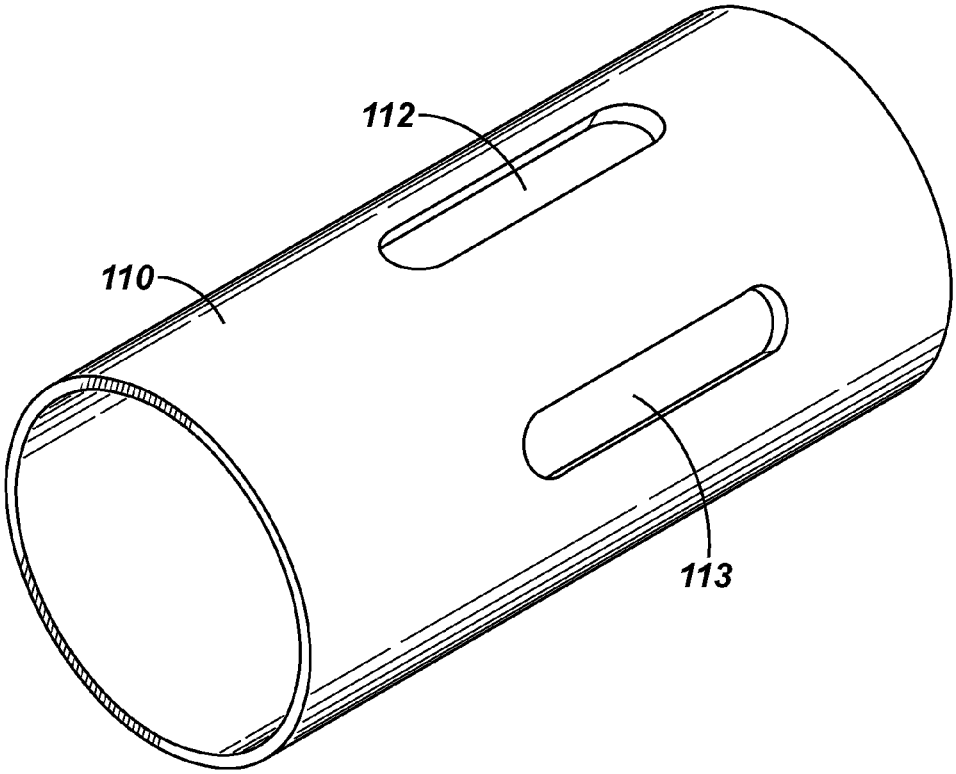
FIG. 2 depicts an isometric view of an illustrative housing of the valve depicted in FIG. 1, according to one or more embodiments described.

FIG. 2 depicts an isometric view of an illustrative housing 110 of the valve 100 depicted in FIG. 1, according to one or more embodiments. Referring to FIGS. 1 and 2, the housing 110 can be a sleeve or tubular member and at least partially disposed about the body 140. The housing 110 can have one or more openings, slots, or flow ports ("ports") (two ports are shown 112, 113) formed therethrough. The ports 112, 113 can be distributed about the housing 110 in any pattern or frequency. For example, one or more ports 112, 113 can be radially disposed about the housing 110 at one or more longitudinal positions thereon and/or two or more ports 112, 113 can be longitudinally disposed about the housing 110 at two or more longitudinal positions thereon. The ports 112, 113 can also be helically or spirally disposed about the housing 110. For example, the ports 112, 113 can be disposed about the housing 110 such that the ports 112, 113 are offset from one another by about 45 degrees, about 50 degrees, about 60 degrees, about 72 degrees, about 80 degrees, about 90 degrees, or more. Any one or more ports 112, 113 can be in fluid communication with any one or more channels 142, 144, 145, 146, 147 of the body 140, depending on the radial orientation of the housing 110 with respect to the body 140.

The first flow gland or end cap 120 can be secured to or engaged with a first end of the housing 110. The second flow gland or end cap 130 can be secured to or engaged with a second end of the housing 110. Preferably, the flow glands 120, 130 form a fluid tight seal with the housing 110 to prevent fluid loss therebetween. Any sealing member or mechanism can be used to provide the seal. For example, the seal can be or include one or more molded rubber seals, composite rubber seals, and/or elastomeric o-rings.

The first flow gland 120 can include one or more flow ports or openings (three are shown 122, 124, 126) formed therethrough. The second flow gland 130 can also include one or more flow ports or openings (one is shown 132) formed therethrough. The flow ports 122, 124, 126, 132 provide an opening or path for fluid flow into or from the body 140. The flow ports 124, 126 can be offset from one another. The offset can range from about less than 1 degree to 350 degrees. In one or more embodiments, flow ports 124, 126 can be offset from one another by less than 10 degrees, about 10 degrees, about 20 degrees, about 25 degrees, about 30 degrees, about 45 degrees, about 90 degrees, about 100 degrees, about 115 degrees, about 120 degrees, about 130 degrees, about 144 degrees, about 150 degrees, or more. More ranges include 10 degrees to 150 degrees, 20 degrees to 120 degrees, 30 degrees to 100 degrees, 40 degrees to 90 degrees, and 30 degrees to 60 degrees.

Figure 3:
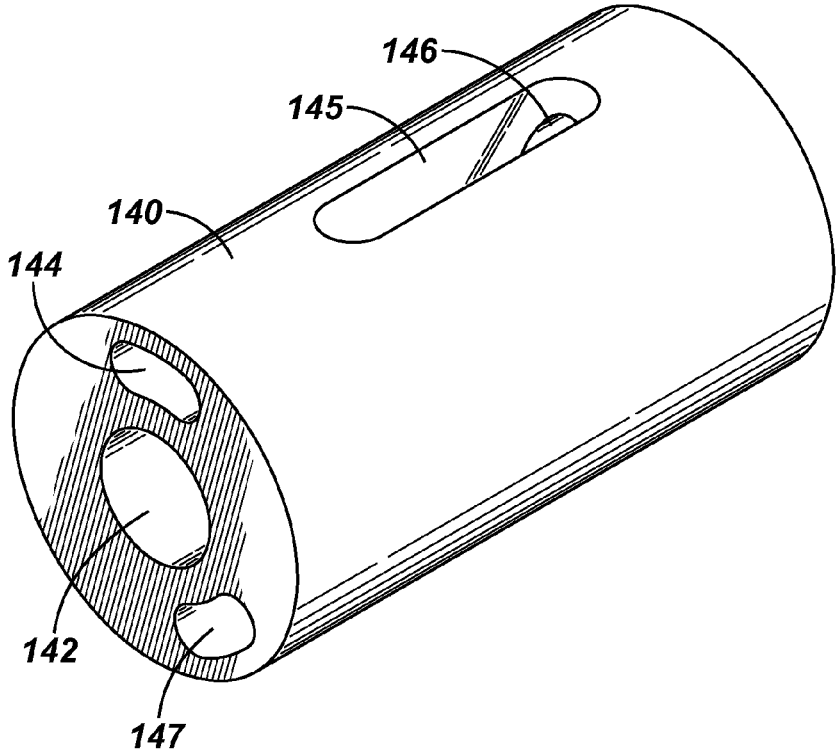
FIG. 3 depicts an isometric view of an illustrative body of the valve depicted in FIG. 1, according to one or more embodiments described.

FIG. 3 depicts an isometric view of an illustrative body 140 of the valve 100 depicted in FIG. 1, according to one or more embodiments. Referring to FIGS. 1 and 3, the channels 142, 144, 145, 146, 147 can be formed through at least a portion the body 140. The channels 142, 144, 145, 146, 147 can be selectively formed through the body 140 such that the channels 142, 144, 145, 146, 147 can be aligned with one or more portions of the housing 110 and/or the flow glands 120, 130 to provide one or more flow paths through the valve 100. In one or more embodiments, each channel 142, 144, 145, 146 can be in fluid communication with one another and not in fluid communication with the channel 147.

The body 140 can be at least partially disposed within the housing 110 between the first flow gland 120 and the second flow gland 130. The body 140 can be manipulated relative to the housing 110 and/or the flow glands 120, 130 to provide one or more flow paths through the valve 100. For example, in a first position, the body 140 can be oriented within the housing 110 so that the channel 142 aligns with the flow port 122 and the channel 144 aligns with the flow port 126. As such, in the first position a first flow path can be provided through the valve 100 between the flow ports 122, 126. In a second position, the body 140 can be oriented so that the channel 142 aligns with the flow port 122, the channel 145 aligns with at least one of the ports 112, 113, and the channel 147 aligns with the flow ports 132, 126. As such, in the second position, a second flow path can be provided through the valve 100 between the ports 122, 126, 132 of the flow glands 120, 130, and at least one of the ports 112, 113 of the housing 110. In a third position, the body 140 can be oriented within the housing 110 so that the channel 142 aligns with the flow port 122 and the channel 145 aligns with at least one of the ports 112, 113. As such, in the third position, a third flow path is provided through the valve 100 between the flow port 122 and at least one of the ports 112, 113.

In yet another position, the body 140 can be oriented within the housing 110 so that the channel 142 aligns with the flow port 122 and the channel 146 aligns with the flow port 132, providing a fourth flow path through the valve 100 between the flow port 122 and the flow port 132. In yet another position, the body 140 can be oriented so that the flow port 122 aligns with the channel 142 and the other channels 144, 145, 146, 147 align with solid portions of the housing 110 and/or the flow glands 120, 130, which prevents fluid flow through the valve 100.

The flow glands 120, 130 can also be independently manipulated relative to one another, the housing 110, and/or the body 140 to provide one or more flow paths through the valve 100. For example, in a first position, the flow gland 120 can be oriented within the first end of the housing 110 so that the flow port 122 aligns with the channel 142 and the flow port 126 aligns with the channel 144. As such, in the first position a first flow path can be provided through the valve 100 between the flow ports 122, 126. In a second position, the flow gland 120 can be oriented within the first end of the housing 110 so that the flow port 122 aligns with the channel 142 and the flow port 126 aligns with the channel 147; the housing 110 can be oriented about the body 140 so that at least one of the ports 112, 113 aligns with the channel 145; and the flow gland 130 can be oriented within the second end of the housing 110 such that the flow port 132 aligns with the channel 147. As such, in the second position, a second flow path can be provided through the valve 100 between the ports 122, 126, 132 of the flow glands 120, 130, and at least one of the ports 112, 113 of the housing 110. In a third position, the flow gland 120 can be oriented within the first end of the housing 110 so that the flow port 122 aligns with the channel 142, and the housing 110 can be oriented about the body 140 so that at least one of the ports 112, 113 aligns with the channel 145. As such, in the third position, a third flow path is provided through the valve 100 between the flow port 122 and at least one of the ports 112, 113.

In yet another position, the flow gland 120 can be oriented within the first end of the housing 110 so that the flow port 122 aligns with the channel 142 and the flow gland 130 can be oriented within the second end of the housing 110 so that the flow port 132 aligns with the channel 146, providing a fourth flow path through the valve 100 between the flow port 122 and the flow port 132. In yet another position, the flow gland 120 can be oriented within the first end of the housing 110 so that the flow port 122 aligns with the channel 142 and solid portions thereof align with the channels 144, 146, 147; the housing 110 can be oriented about the body 140 so that solid portions thereof align with the channel 145; and the flow gland 130 can be oriented within the second end of the housing 110 so that solid portions thereof align with the channels 144, 146, 147, which prevents fluid flow through the valve 100.

An actuation device (not shown) can be used to manipulate the body 140, the flow glands 120, 130, and/or the housing 110 either independently of one another or in some combination of two or more to provide the selective flow paths through the valve 100. The actuation device can be any actuation device capable of rotating in-situ at least one of the body 140, the flow glands 120, 130, and/or housing 110. For example, the actuation device can be a hydraulically operated piston with a j-slot or w-slot. Other illustrative actuation methods can include motors, mechanical actuation devices, electro-mechanic actuation devices, and the like.

Figure 4:
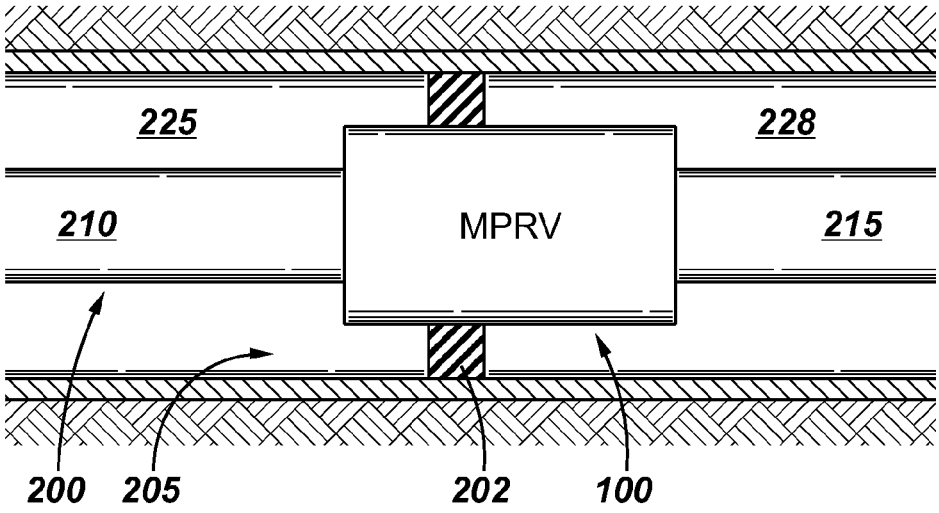
FIG. 4 depicts a schematic representation of various zones within a wellbore that can be selectively serviced by the valve depicted in FIG. 1, according to one or more embodiments described.

FIG. 4 depicts a schematic representation of various zones within a wellbore 205 that can be selectively serviced by the valve 100 depicted in FIG. 1, according to one or more embodiments. As depicted, the wellbore 205 can be divided or separated into at least four distinct zones 210, 215, 225, 228 about the valve 100 and a work string 200. A first zone 210 can be an inner bore of a first or "upper" portion of the work string 200 adjacent the valve 100. A second zone 215 can be an inner bore of a second or "lower" portion of the work string 200 adjacent the valve 100. Accordingly, the valve 100 can separate the zones 210, 215 from one another.

A third zone 225 and a fourth zone 228 can be located within an annulus formed between the wellbore 205 and the work string 200. For example, the third zone 225 and the fourth zone 228 can be isolated from one another by a packer 202 positioned about the valve 100. The third zone 225 can be the portion of the annulus adjacent the first portion of the work string 200. The fourth zone 228 can be the portion of the annulus adjacent the second zone 215.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

As mentioned with reference to FIG. 1, the housing 110, the body 140, and or flow glands 120, 130 can be independently manipulated to provide the one or more flow paths through the valve 100, which places any two or more distinct zones 210, 215, 225, 228 within the wellbore 205 in fluid communication with one another. Accordingly, any number of operations can be performed in-situ using the valve 100. For simplicity and ease of description, however, the valve 100 will be further described with reference to an illustrative gravel packing operation that utilizes circulating, squeeze, reverse, washdown, and/or blank operation modes.

Figure 5:
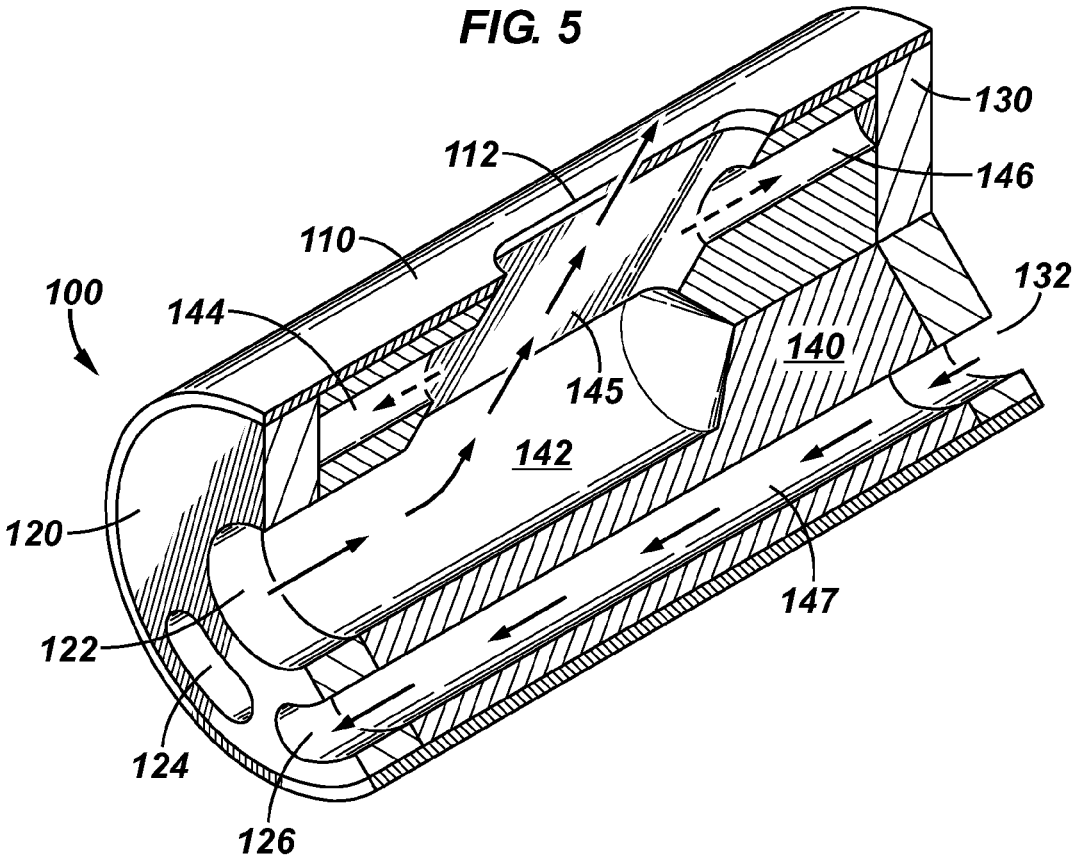
FIG. 5 depicts a cross-sectional view of the valve depicted in FIG. 1 in a circulating operation mode, according to one or more embodiments described.

FIG. 5 depicts a cross-sectional view of the valve 100 in a circulating operation mode, according to one or more embodiments. As depicted, the valve 100 can be placed in circulating operation mode by aligning the channel 145 with the port 112, aligning the channel 142 with the flow port 122, and aligning the channel 147 with the flow ports 126, 132. The channel 144 is aligned with a solid portion of the first flow gland 120, preventing fluid flow through the channel 144. The channel 146 is also aligned with a solid portion of the second flow gland 130, preventing fluid flow through the channel 146. Consequentially, the valve 100 provides fluid communication between the first zone 210 and the fourth zone 228 and the second zone 215 and the third zone 225 and prevents fluid communication between the first zone 210 and the second zone 215, the third zone 225 and the fourth zone 228, the second zone 215 and the fourth zone 228, and the third zone 225 and the first zone 210.

Figure 6:
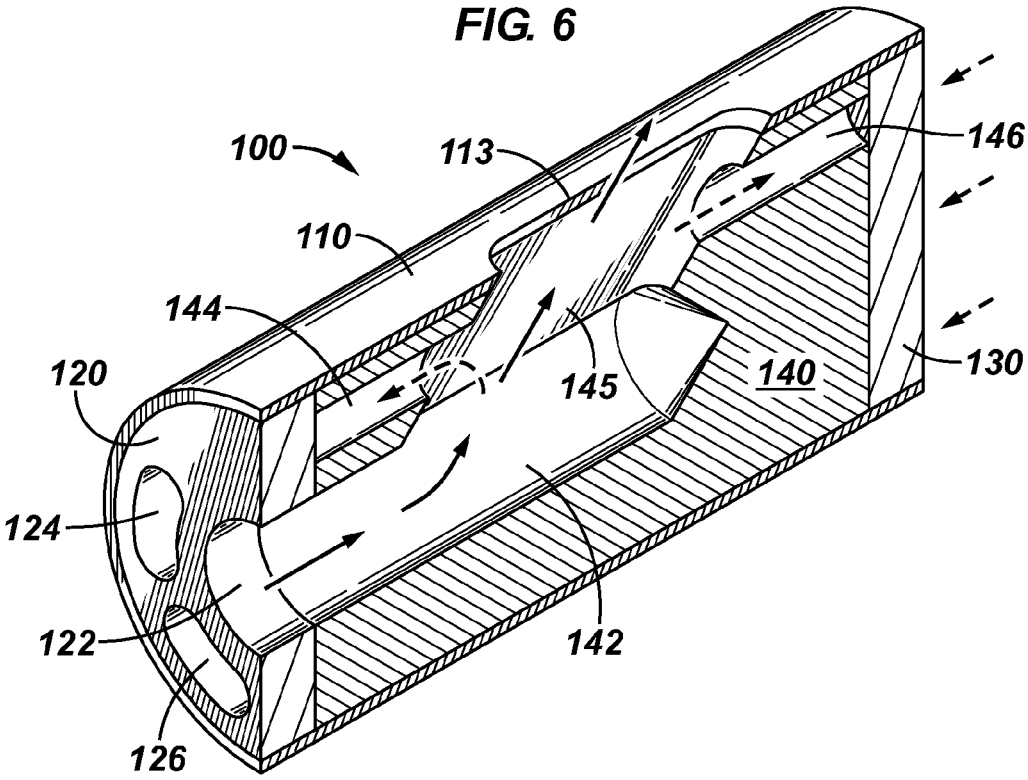
FIG. 6 depicts a cross-sectional view of the valve depicted in FIG. 1 in a squeeze operation mode, according to one or more embodiments described.

FIG. 6 depicts a cross-sectional view of the valve 100 in a squeeze operation mode, according to one or more embodiments. In squeeze operation mode, the channel 142 is aligned with the flow port 122, and the channel 145 is aligned with the port 113. The alignment of the channel 142 with the flow port 122 and the channel 145 with the port 113 forms a flow path from the flow port 122 to the port 113 via channels 142, 145. Further, the channels 144, 146, 147 are isolated by solid portions of the first flow gland 120 and the second flow gland 130. Accordingly, when the valve 100 is in squeeze operation mode, the valve 100 provides fluid communication between the first zone 210 and the fourth zone 228 and prevents fluid communication between the first zone 210 and the second zone 215, the second zone 215 and the third zone 225, the third zone 225 and the fourth zone 228, and the third zone 225 and the first zone 210.

Figure 7:
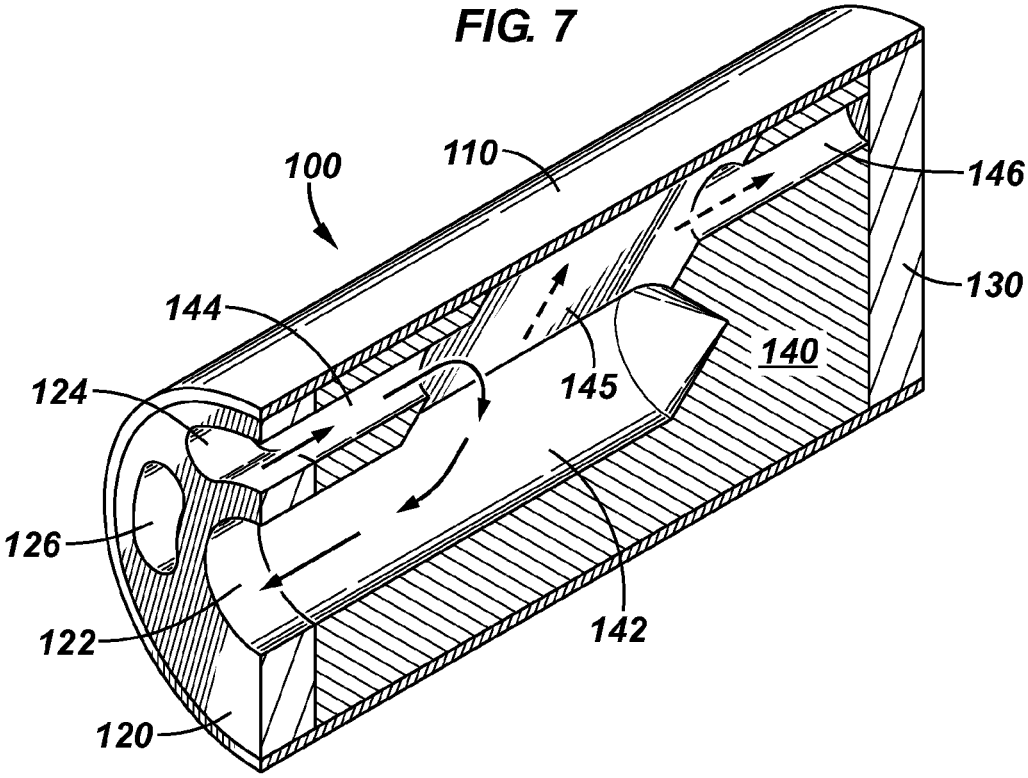
FIG. 7 depicts a cross-sectional view of the valve depicted in FIG. 1 in a reverse operation mode, according to one or more embodiments described.

FIG. 7 depicts a cross-sectional view of the valve 100 in a reverse operation mode, according to one or more embodiments. When the valve 100 is in reverse operation mode, the channel 142 is aligned with the flow port 122. Additionally, the channel 144 is aligned with the flow port 124. Accordingly, a flow path is provided through the valve 100 between flow port 124 and the flow port 122 via channels 144, 142. Further, the channels 146, 147 of the body 140 are aligned with solid portions of the flow glands 120, 130, which isolate the channels 146, 147. The channel 145 is aligned with the housing 110, which isolates the channel 145. Accordingly, when the valve 100 is in the reverse operation mode, the valve 100 provides fluid communication between the third zone 225 and the first zone 210 and prevents fluid communication between the first zone 210 and the second zone 215, the second zone 215 and the fourth zone 228, and the third zone 225 and the fourth zone 228.

Figure 8:
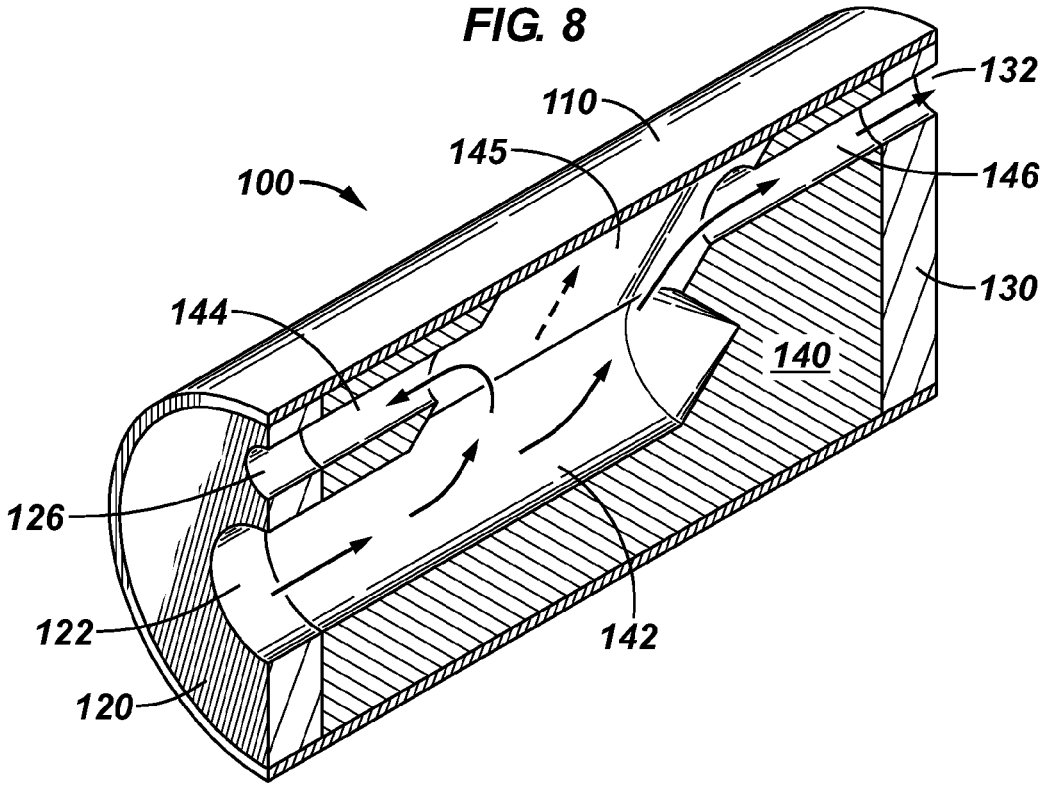
FIG. 8 depicts a cross-sectional view of the valve depicted in FIG. 1 in a washdown operation mode, according to one or more embodiments described.

FIG. 8 depicts a cross-sectional view of the valve 100 in a washdown operation mode, according to one or more embodiments. When the valve 100 is in washdown operation mode, the channel 142 is aligned with the flow port 122, the channel 144 is aligned with the flow port 126, and the channel 146 is aligned with the flow port 132. Furthermore, when the valve 100 is in a washdown operation mode, the channel 147 is aligned with solid portions of the first flow gland 120 and the second flow gland 130, which isolate the channel 147. The channel 145 is aligned with a solid portion of the housing 110, which isolates the channel 145. Accordingly, in washdown operation mode, the valve 100 provides fluid communication between the first zone 210 and the second zone 215 and the first zone 210 and the third zone 225 and prevents fluid communication between the first zone 210 and fourth zone 228, the third zone 225 and the second zone 215, the fourth zone 228 and the second zone 215, and the fourth zone 228 and the third zone 225.

In one or more embodiments, it may be desirable to isolate the third zone 225 and the first zone 210. For example, fluid communication between the third zone 225 and the first zone 210 can be undesirable if the third zone 225 is producing hydrocarbons concurrently with the washdown operation. Accordingly, in one embodiment, when the valve 100 is in a washdown operation mode, the valve 100 can be configured such that the channel 144 is aligned with a solid portion of the flow gland 120, the channel 142 is aligned with the flow port 122, the channel 146 is aligned with the flow port 132, the channel 147 is aligned with solid portions of the first flow gland 120 and the second flow gland 130, and the channel 145 is aligned with a solid portion of the housing 110. Accordingly, the valve 100 can provide fluid communication between the first zone 210 and the second zone 215 and prevent fluid communication between the first zone 210 and fourth zone 228, the third zone 225 and the second zone 215, the fourth zone 228 and the second zone 215, the fourth zone 228 and the third zone 225, and the third zone 225 and the first zone 210.

Figure 9:
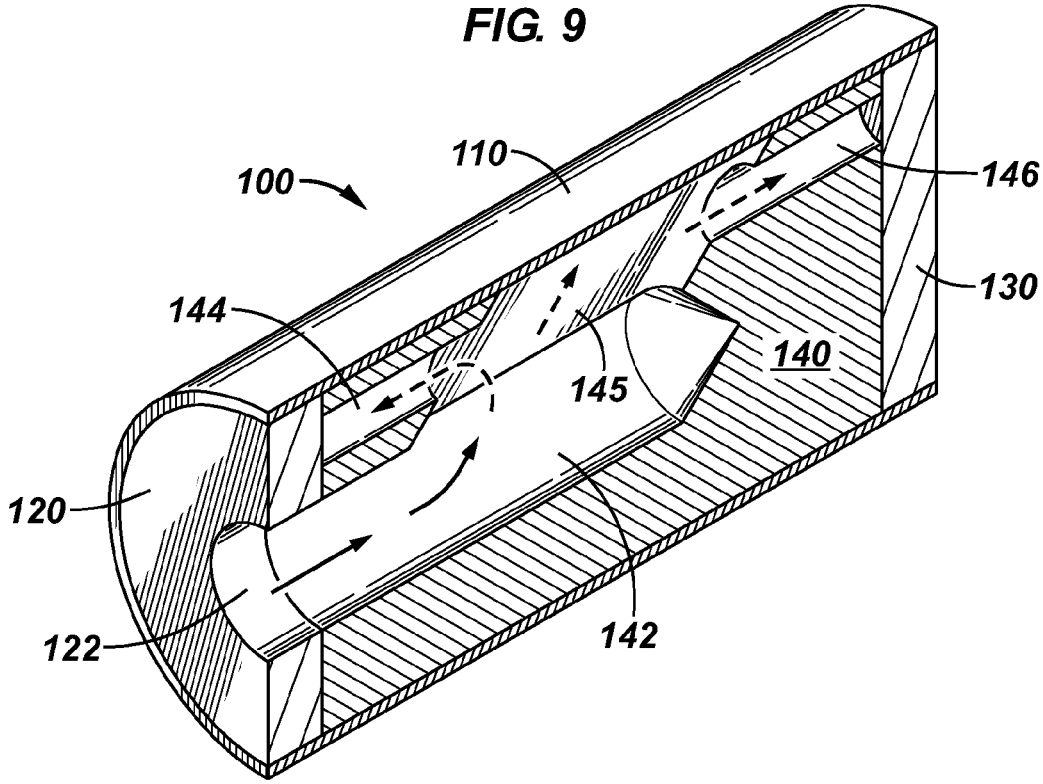
FIG. 9 depicts a cross-sectional view of the valve depicted in FIG. 1 in a blank operation mode, according to one or more embodiments described.

FIG. 9 depicts a cross-sectional view of the valve 100 in a blank operation mode, according to one or more embodiments. When the valve 100 is in blank operation mode, the channel 142 of the body 140 is aligned with the flow port 122 of the first flow gland 120. However, the solid portions of the first flow gland 120 and the second flow gland 130 align with and isolate the channels 144, 146, 147 of the body 140. Additionally, a solid portion of the housing 110 aligns with and isolates the channel 145 of the body 140. Accordingly, the valve 100 prevents fluid communication between all wellbore zones 210, 215, 225, 228.

In addition to gravel pack operations such as the illustrative operation above, the valve 100 can be used in various other applications that require selective isolation of one or more wellbore zones. For example, the valve 100 can be integrated with one or more downhole completions to provide multiple flow paths through the completion without requiring longitudinal movement of the completion relative to the wellbore. The valve 100 can also be integrated with various subterranean systems. For example, the valve 100 can be used with steam assisted gravity drainage systems, carbon sequestering systems, water storage systems, and steam injection systems.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A downhole tool, comprising:

a work string adapted to be disposed within a wellbore;

a valve coupled to the work string, wherein the valve is disposed between a first portion of the work string and a second portion of the work string, and wherein the valve comprises:

a housing comprising a first end and a second end and a first port formed radially therethrough;

a first flow gland disposed at the first end of the housing and having second and third ports formed axially therethrough;

a second flow gland disposed at the second end of the housing and having a fourth port formed axially therethrough; and a body disposed within the housing and between the first flow gland and the second flow gland; and a packer disposed on an outer surface of the valve and adapted to isolate a first annulus from a second annulus, wherein the first annulus is disposed adjacent the first portion of the work string, and the second annulus is disposed adjacent the second portion of the work string, wherein at least one of the housing, the first flow gland, and the second flow gland is adapted to be rotated with respect to the body to form a flow path between at least two of the first portion of the work string, the second portion of the work string, the first annulus, and the second annulus.

2. The tool of claim 1, wherein the flow path is adapted to carry out at least one of a squeeze operation, a circulating operation, a blank operation, a washdown operation, and a reverse operation.

3. The tool of claim 1, wherein the housing further comprises a fifth port formed radially therethrough, and wherein the fifth port is circumferentially offset from the first port.

4. The tool of claim 1, wherein the third port is positioned radially-outward from the second port.

5. The tool of claim 4, wherein the first flow gland further comprises a fifth port formed axially therethrough, and wherein the fifth port is circumferentially offset from the third port.

6. The tool of claim 1, wherein the body comprises:

a first axially-extending channel in fluid communication with the second port; and a second axially-extending channel in fluid communication with the first axially-extending channel, and wherein the second axially-extending channel is disposed radially-outward from the first axially-extending channel.

7. The tool of claim 6, wherein the flow path extends between the first portion of the work string and the first annulus when the third port is aligned with the second axially-extending channel.

8. The tool of claim 6, wherein the flow path extends between the first portion of the work string and the second portion of the work string when the fourth port is aligned with the second axially-extending channel.

9. The tool of claim 1, wherein the flow path extends from the first portion of the work string, through the first port and the second port, and to the second annulus.

10. The tool of claim 1, wherein the flow path extends from the second portion of the work string, through the third port and the fourth port, and to the first annulus.

11. The tool of claim 1, wherein the flow path extends from the first portion of the work string, through the second port and the third port, and to the first annulus.

12. The tool of claim 1, wherein the flow path extends from the first portion of the work string, through the second port and the fourth port, and to the second portion of the work string.

13. A method for performing a series of downhole operations, comprising:

conveying a work string with an integrated valve into a wellbore, wherein the valve comprises:

a housing comprising a first end and a second end and a first port formed radially therethrough;

a first flow gland disposed at the first end of the housing and having second and third ports formed axially therethrough;

a second flow gland disposed at the second end of the housing and having a fourth port formed axially therethrough; and a body disposed within the housing and between the first flow gland and the second flow gland;

isolating a first annulus from a second annulus with a packer disposed on an outer surface of the valve, wherein the first annulus is disposed adjacent the first portion of the work string, and the second annulus is disposed adjacent the second portion of the work string; and rotating at least one of the housing, the first flow gland, and the second flow gland with respect to the body to form a flow path between at least two of the first portion of the work string, the second portion of the work string, the first annulus, and the second annulus.

14. The method of claim 13, further comprising rotating at least one of the housing, the first flow gland, and the second flow gland with respect to the body without imparting longitudinal motion to the work string relative to the wellbore.

15. The method of claim 13, wherein the flow path provides fluid communication between the first portion of the work string and the second annulus.

16. The method of claim 13, wherein the flow path provides fluid communication between the second portion of the work string and the first annulus.

17. The method of claim 13, wherein the flow path provides fluid communication between the first portion of the work string and the first annulus.

18. The method of claim 13, wherein the flow path provides fluid communication between the first portion of the work string and the second portion of the work string.

19. The method of claim 13, further comprising rotating at least one of the housing, the first flow gland, and the second flow gland with respect to the body to block the flow path.

20. The method of claim 13, further comprising flowing a fluid through the flow path to perform at least one of a circulating operation, a squeeze operation, a reverse operation, and a washdown operation.

* * * * *